US009302312B2

(12) United States Patent
Sachdev et al.

(10) Patent No.: US 9,302,312 B2
(45) Date of Patent: Apr. 5, 2016

(54) LUBRICATION SYSTEM FOR WARM FORMING

(71) Applicant: GM GLOBAL TECHNOLOGY OPERATIONS LLC, Detroit, MI (US)

(72) Inventors: Anil K. Sachdev, Rochester Hills, MI (US); William R. Rodgers, Bloomfield Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 108 days.

(21) Appl. No.: 14/174,888

(22) Filed: Feb. 7, 2014

(65) Prior Publication Data

US 2015/0224558 A1 Aug. 13, 2015

(51) Int. Cl.

| | |
|---|---|
| ***B21D 37/18*** | (2006.01) |
| ***B21D 22/02*** | (2006.01) |
| *B21D 35/00* | (2006.01) |

(52) U.S. Cl.

CPC ..... *B21D 37/18* (2013.01); *B21D 22/022* (2013.01); *B21D 35/005* (2013.01)

(58) Field of Classification Search

CPC ..... B21D 37/18; B21D 37/16; B21D 22/286; B21D 22/022; B21D 35/005; B30B 15/0088

USPC ..... 72/38–45, 342.1, 342.2, 342.3, 342.5, 72/342.6, 379.2, 364

See application file for complete search history.

(56) References Cited

U.S. PATENT DOCUMENTS

| | | | | |
|---|---|---|---|---|
| 5,191,779 | A * | 3/1993 | Imazu et al. | 72/46 |
| 5,584,201 | A * | 12/1996 | Graham et al. | 72/42 |
| 6,004,911 | A * | 12/1999 | Nohira et al. | 508/539 |
| 6,006,564 | A * | 12/1999 | Frisby et al. | 72/41 |
| 6,516,645 | B2 * | 2/2003 | Morales et al. | 72/53 |
| 6,550,302 | B1 * | 4/2003 | Ghosh | 72/342.8 |
| 7,730,753 | B2 | 6/2010 | Krajewski et al. | |
| RE43,012 | E | 12/2011 | Rashid et al. | |
| 2009/0205394 | A1 * | 8/2009 | Luckey et al. | 72/379.2 |
| 2010/0011826 | A1 * | 1/2010 | Buehler et al. | 72/42 |
| 2010/0288644 | A1 * | 11/2010 | Brown et al. | 205/80 |

* cited by examiner

*Primary Examiner* — Peter DungBa Vo
*Assistant Examiner* — Joshua D Anderson
(74) *Attorney, Agent, or Firm* — Reising Ethington P.C.

(57) ABSTRACT

Sheet metal workpieces are preheated to a temperature in the range of about 100° C. to about 500° C. for warm forming between press-actuated forming dies. The forming dies are not heated, but are coated with a liquid lubricating material suitable for the forming of the preheated sheet metal workpiece. For example, the liquid lubricating material is suitably a halogenated hydrocarbon that will adhere to unheated die surfaces and serve in the forming of the sheet metal workpiece into a vehicle body panel or other product. But the liquid lubricating material is composed so as to evaporate from surfaces of the formed workpiece at a temperature below about 200° C., so that the workpiece does not have to be cleaned before it is decoratively finished. The lubricant material may be vaporized, for example, into a warm stream of air or nitrogen and carried to a recovery or disposal system.

20 Claims, 3 Drawing Sheets

LUBRICATION SYSTEM FOR WARM FORMING

TECHNICAL FIELD

This disclosure pertains to a lubrication practice for the warm forming of sheet metal alloys, such as aluminum alloys, in which a preheated sheet metal blank is formed into a complex shape between opposing unheated forming dies. More specifically, a lubricant is applied to the unheated die surfaces just before the hot sheet metal blank is inserted between the dies. The lubricant composition is chosen to enhance the forming of the sheet metal and to be vaporized as the dies are opened for part removal. The lubricant is selected so as to be substantially self-removing to minimize or avoid lubricant-removal processing of the formed sheet metal or the metal dies.

BACKGROUND OF THE INVENTION

Body panels for automotive vehicles typically comprise a formed outer sheet layer and a formed inner sheet layer which have complementary shapes and are attached at their peripheral edges in forming a hollow body panel structure. Such two-layer panels may serve as door panels, deck lids, tailgates, or the like, and the panel members are shaped to serve both utilitarian and decorative functions when assembled into a vehicle body structure.

Metal forming processes have been used to provide body panels of various shapes for automotive vehicles. But there remains a need to provide high quality panels with more complex shapes while maintaining acceptable forming costs.

SUMMARY OF THE INVENTION

This invention provides a method to facilitate the forming of sheet metal workpieces into complex shapes such as are required in making inner or outer door panels, or other panels used in the making of body members for attractive and functional automotive vehicles. The invention is applicable, for example, to the forming of steel alloys, aluminum-based alloys, or magnesium-based alloys of compositions that are suitable for straining and shaping into such complex three-dimensional shapes at forming temperatures in the range of, for example, about 100° C. to about 500° C. The invention is particularly intended for the forming of a sheet of an aluminum alloy or a magnesium alloy, about one-half millimeter to about three millimeters in thickness, which has been preheated to a forming temperature in this range.

Depending on the panel shape to be attained and the forming characteristics of the sheet metal alloy, the forming of a panel may require successive forming steps between two or more sets of opposing die members with precisely machined forming surfaces. The opposing dies are usually carried on and activated by a large hydraulic or mechanical press. Each die member is typically a massive body, rectangular in cross section, formed of a cast tool steel composition with a forming surface carefully machined into the cast body. Two (or more) such dies with complementary forming surfaces are press-actuated to engage opposing sides of a relatively thin sheet metal workpiece. Each die closure and sheet metal forming step is typically completed within a period of a second to a few seconds. Then the dies are opened by press action and the workpiece removed from between the dies and from the press region.

In accordance with practices of this invention, the initial sheet metal blank is heated to a forming temperature, predetermined by experience or experiment, to facilitate careful and complex shaping of the metal alloy sheet material (often an aluminum or magnesium alloy). The sheet metal alloy blank is preheated, but it is not coated with a lubricant. Instead, the forming surfaces of the opposing dies are coated, uniformly or selectively, with a mobile lubricant that suitably separates the die and workpiece surfaces during deformation of the sheet metal alloy workpiece, but the lubricant then vaporizes, escapes, or is carried away in a gas stream as the dies are opened. The lubricant is selected to eliminate or minimize the formation of a residue on the formed workpiece that requires an expensive, time-consuming removal step.

The massive dies (often weighing a ton or more) are not heated above an ambient temperature, except as they may be warmed by the repeated deformation and forming of preheated workpieces. Typically, the lubricant may be sprayed as a liquid on the die surfaces or spread with an applicator, like painting, on the die surfaces. Typically such a lubricant is applied before each use of the die members in a forming operation. But the intent and purpose of the method of this invention is to avoid having to devote significant time, materials, and labor to remove residual lubricant from surfaces of the formed workpiece or surfaces of the forming tool.

The lubricant is selected to adhere to the surfaces of the unheated forming dies as the heated sheet metal workpiece is inserted for forming and to provide necessary lubrication between the surfaces of the opposing dies and the opposing surfaces of the workpiece during the brief duration of the metal forming step. Then, as the dies are opened and the relatively hot workpiece separated from the die surfaces, the lubricant is to vaporize from the respective surface. It is preferred that the lubricant be vaporizable at a temperature below about 200° C. Vaporization of the lubricant from the workpiece surfaces may be aided by a stream of air, or the like, carried into a vapor removal duct, and conducted from the region of the forming dies and press to a lubricant material recovery site or disposal site. Halogenated hydrocarbons, such as ethylene dibromide, are considered to be candidate lubricant materials. Members of this class of halogenated hydrocarbon materials have suitably durable lubricant properties for the warm forming of aluminum alloys, for example, and have suitable volatility for quick removal from workpiece surfaces (and from die surfaces, if necessary) by evaporation into a vapor removal stream or vapor removal system at the press location.

Other objects and advantages of the invention will be apparent from the following detailed description of specific examples of practices of the invention.

BRIEF DESCRIPTION OF THE DRAWINGS

In FIG. 1, a lubricant spray device is also indicated, which is capable of insertion into and removal from the opening between the dies for applying a liquid lubricant in a desired lubricant coating pattern to the forming surfaces of the forming dies.

DESCRIPTION OF PREFERRED EMBODIMENTS

Figure 1:
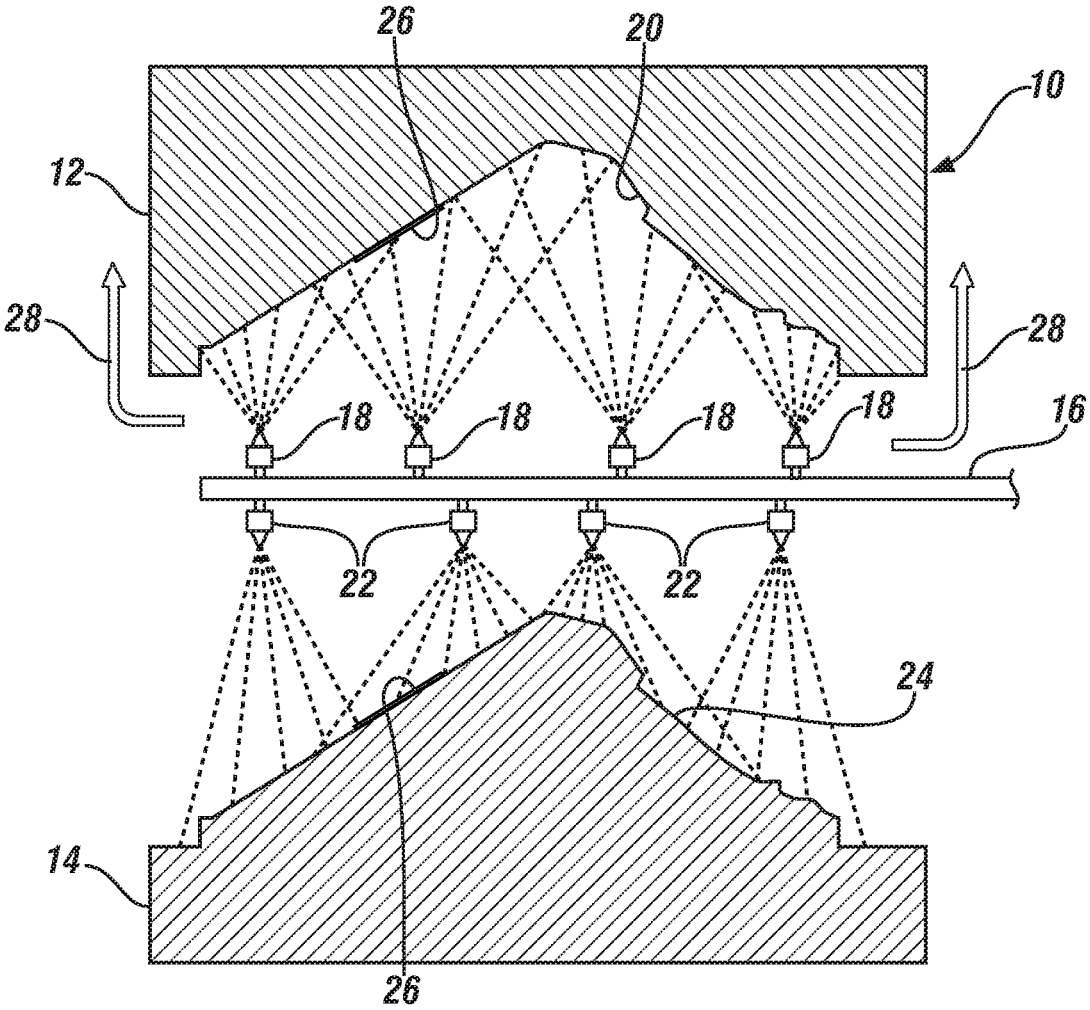
FIG. 1 is an elevation view, in cross-section of upper and lower forming die members shaped for forming an outer deck lid panel for an automotive vehicle. In their use the opposing forming die members would be supported on a press mechanism for moving the die members between an open position for insertion of a sheet metal workpiece (as shown in FIG. 1) and a closed position by which the sheet metal is formed. For simplicity of viewing, the press mechanism is not shown in FIG. 1 or other drawing figures.

Practices of this invention may be usefully applied to sheet metal alloys that are suitably formable when they are heated to temperatures in the range of about 100° C. to about 500° C. and deformed into a predetermined workpiece shape between forming surfaces of opposed, press-supported and press-actuated forming dies. Often, relatively thin sheets of aluminum-based alloys and magnesium-based alloys are warm-formable by practices of this invention. Examples of suitable aluminum alloys include AA3104, AA5182, AA5754, and AA6111. Examples of suitable magnesium alloys include AM30, AZ31, and ZEK100. The method of this invention may also be applied to steel alloys (especially of low alloy element content) that are composed for forming between complementary forming dies at temperatures in the above specified range.

Practices of the invention require the use of a suitable liquid lubricant material. The liquid lubricant is applied to unheated, forming die surfaces and adheres to the die surfaces while a preheated sheet metal blank, or previously heated and partly-formed workpiece, is placed between the liquid-film coated, facing die surfaces. The dies are closed against the surfaces of the sheet metal workpiece and the lubricant serves in the die-forming of the hot workpiece. But when the dies are opened from contact with the surfaces of the workpiece, any lubricant remaining on the workpiece will vaporize and leave the surface at a temperature below about 200° C. The vaporization and removal of any lubricant on surface portions of the workpiece may be facilitated by directing a suitable stream of air, nitrogen, or the like over the surfaces of the sheet metal workpiece.

Examples of suitable lubricant materials include selected members from the classes of halogenated hydrocarbons. Brominated and iodinated hydrocarbons are preferred, especially brominated alkane hydrocarbons, such as dibromo ethane and dibromo methane. This is because of their minimal flammability as well as their ideal boiling points for this process. Additionally, to facilitate application, it is useful if the lubricant is a liquid at room temperature. A non-exclusive list of potential lubricant materials is given in Table 1.

TABLE 1

| Chemical Name | Boiling Point (° C.) |
|---|---|
| 1-bromopropane | 71 |
| 1-iodoethane | 72 |
| 2-bromo-2-methylpropane | 73 |
| 2-iodopropane | 89 |
| dibromo methane | 97 |
| 1-iodopropane | 103 |
| 1-bromo-2,2-dimethylpropane | 106 |
| 1,1-dibromoethane | 108 |
| 2,2-dibromopropane | 115 |

TABLE 1-continued

| Chemical Name | Boiling Point (° C.) |
|---|---|
| 1,2-dibromoethane | 131 |
| 1,1-dibromopropane | 134 |
| 1,2-dibromopropane | 140 |
| 2-bromoethanol | 149 |
| tribromo methane | 150 |
| 1,2-dibromo-2-methylpropane | 150 |
| 1,3-dibromopropane | 167 |
| 1,1-diiodoethane | 179 |
| 1,1-dibromo-2,2-dimethylpropane | 180 |
| diiodo methane | 182 |
| 1,1,2-tribromoethane | 189 |

Thus, bromine or iodine containing alkanes (or alkanols) containing one to five carbon atoms are preferred as liquid lubricants in practices of this warm forming method. Since these compounds contain halogens, the potential for the vaporized lubricant to burn is lowered compared to non-halogenated compounds, even though the vaporization points of the non-halogenated compounds are suitable. Examples of these less preferred materials would be ethylene glycol or n-decane.

As stated above in this specification, complementary forming tools are used to shape initially-flat, sheet metal workpieces into complexly shaped three-dimensional articles such a body panels for automotive vehicles. The formed panels or other articles serve a critical structural purpose while also being designed to manage air flow around a vehicle and to be visually attractive and compatible with all vehicle surfaces. For example, a vehicle outer deck lid panel (such as is illustrated at 100 in FIG. 4) typically has a generally horizontal portion for enclosing the top of a vehicle storage area and a generally vertical portion for enclosing the rear of the storage area and forming a critical rear surface of the vehicle. The vertical surface of the outer deck lid panel often has an indented area for application of a license plate. And both the horizontal and vertical portions of the deck lid panel often have complex curvatures in both their front to rear directions and their cross-body directions. Further, as the shape of the metal alloy panel proceeds from its horizontal region to its vertical region, the panel may have ridges or formed sections across the width of the panel with relatively small, difficult to form, radii of curvature. In other words, virtually every square centimeter of the metal surface has been reshaped by a forming action from a flat surface to a complexly curved surface to serve both a specified total functional and visual purpose. Suitable large (and expensive) complementary forming tools are prepared to impart the required shape to an initial flat sheet metal workpiece.

In many embodiments, the forming tools will comprise complementary male and female dies with forming surfaces that are carefully machined from cast blocks of tool steel or other suitable material. Each such tool is typically quite heavy (a ton, or more, in weight) and are supported in opposing, facing positions in a suitable press machine with their intended forming surfaces aligned. The press may, for example, be mechanically or hydraulically actuated. The male and female dies are typically aligned to be separated and closed along a vertical axis.

Figure 4:
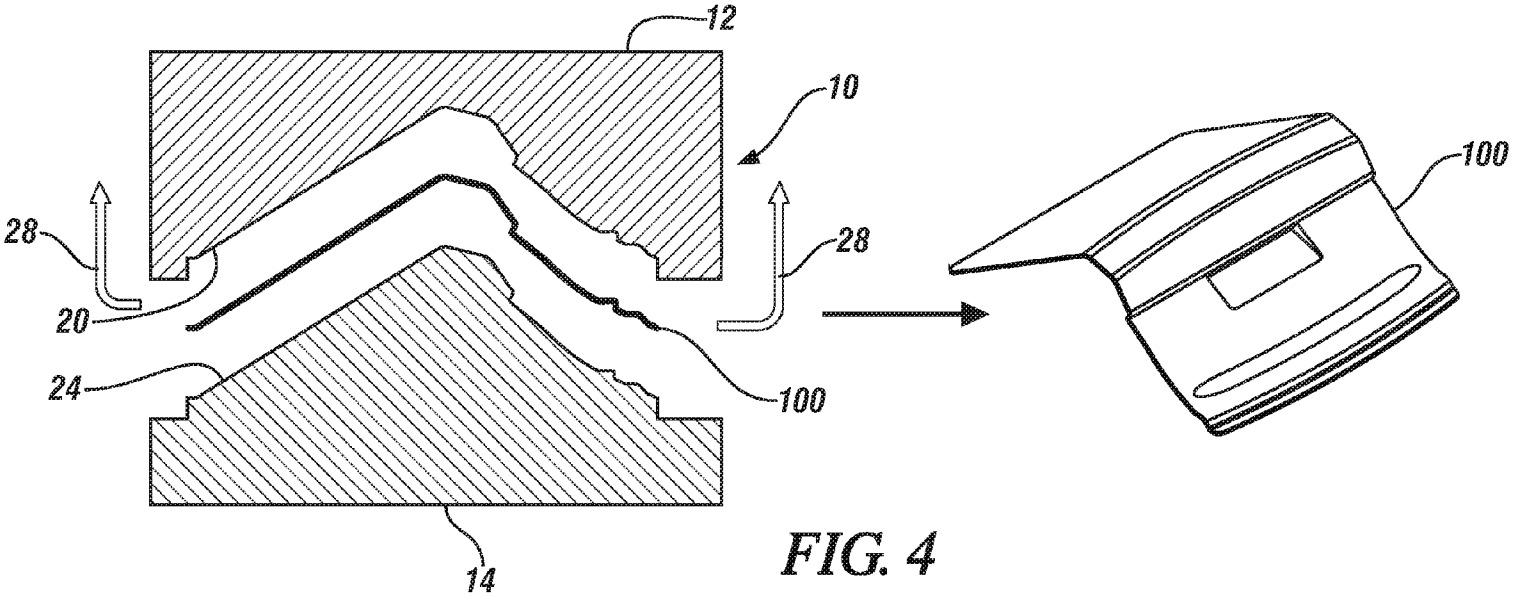
FIG. 4 illustrates the forming dies in their opened position for removal of a formed deck lid panel, and illustrates the formed deck lid panel in an oblique view.

In FIG. 1, an assembly 10 of an upper female die 12 and lower male die 14 are illustrated in cross-section, to display a line of curvature of a section of an outer deck lid panel 100 as illustrated in oblique view in FIG. 4. Female die 12 and male die 14 are supported by a suitable press (not illustrated) for raising and lowering of the female die 12 along a vertical axis, into and out of forming position with respect to stationary male die 14. In FIG. 1, upper die 12 is raised to an open die member position (or open press position) with respect to complementary lower die 14. In accordance with practices of this invention, die members 12 and 14 are not heated, except as they may be warmed by repetitive forming operations. Such dies may attain a temperature of, for example, 40° C. or so when repeatedly used to warm form sheet metal blanks. An expensive die set may be used to make many formed workpieces in a work shift in which the press is used. And an initially flat sheet metal blank may be subjected to forming by more than one press and die set in order to complete the intended shaping of a workpiece into a suitably formed and trimmed article.

As an example, an outer deck lid panel, like that identified with numeral 100 in FIG. 4, may be formed of aluminum alloy 5182 in which the sheet metal workpiece is preheated to a temperature of about 225° C. This warm forming method is further practiced as follows.

A liquid lubricant is applied to one or both of the forming surfaces of the forming dies. In one embodiment of the invention, the liquid lubricant is sprayed onto the forming surfaces of both the upper die 12 and lower die 14. As illustrated in FIG. 1, liquid lubricant such as 1,3-dibromo propane is delivered from a lubricant tank (not shown) through spray tube 16 and directed through a set of upper nozzles 18 against forming surface 20 of upper die 12, and through a set of lower nozzles 22 against forming surface 24 of lower die 14. The assemblage of spray tube(s) and nozzles may be mounted on a supporting structure (not shown) for easy insertion into the space between the open dies for application of the lubricant and readily withdrawn for loading and forming of the heated sheet metal blank. The number and locations of the respective nozzles 18, 22 are determined to quickly and efficiently provide a thin coating or film 26 of the liquid lubricant on both forming surfaces 20, 24. A small portion of the liquid coating film 26 (which covers each forming surface) is illustrated in FIG. 1 and is depicted with an exaggerated thickness to illustrate its presence on the surfaces 20, 24. The liquid film 26 is applied to all surface areas 20, 24 of each die member 12, 14 which are expected to contact the sheet metal workpiece or to otherwise require lubrication.

The composition of the liquid film 26 material is selected to provide suitable lubrication of the unheated forming die surfaces 20, 24 and of the surfaces of the heated sheet metal workpiece. A number of liquid lubricants and their corresponding atmospheric pressure boiling points are listed in Table 1. As stated in this specification, the lubricant is selected for both its lubrication properties in the forming of the sheet metal workpiece (e.g., workpiece 30 in FIG. 2) and for its capacity to be vaporized from the surfaces of the formed sheet metal workpiece. In some embodiments of the invention, it may be desirable to select a liquid lubricant with a higher boiling point when it is intended to heat the sheet metal workpiece to a higher temperature in the range of about 100° C. to about 500° C. In some workpiece forming embodiments, it may be helpful to use a radiant heater (or other localized heating device) in combination with a carrier gas system to remove liquid lubricant material from the formed sheet metal workpiece.

Since the liquid lubricant is expected to form a vapor during and subsequent to the forming operation, it is preferred to provide a vapor evacuation system (indicated by arrows 28 in FIGS. 1 and 4), such as a carrier gas stream of air or nitrogen, for removal and recovery of lubricant vapor from the workpiece and the region of the press. For example, evacuation system 28 may comprise a duct system, provided to draw vapor-laden air (or a stream of another vapor carrying gas) from the region of the forming dies 12, 14 and to carry the vapor to a vapor recovery area. For example, carrier stream may be cooled to condense lubricant as a liquid for separation from the carrier gas stream. In another example, the lubricant vapor may be adsorbed or absorbed onto a particulate adsorbent material or other vapor-entraining material. In many operations the lubricant material may be recovered and reused. The evacuation system 28 may also comprise movable surfaces which may be placed around the dies 12, 14 in their open position to confine lubricant vapor in the region of the dies and to help direct the vapor into a vapor-removal duct system.

Figure 2:
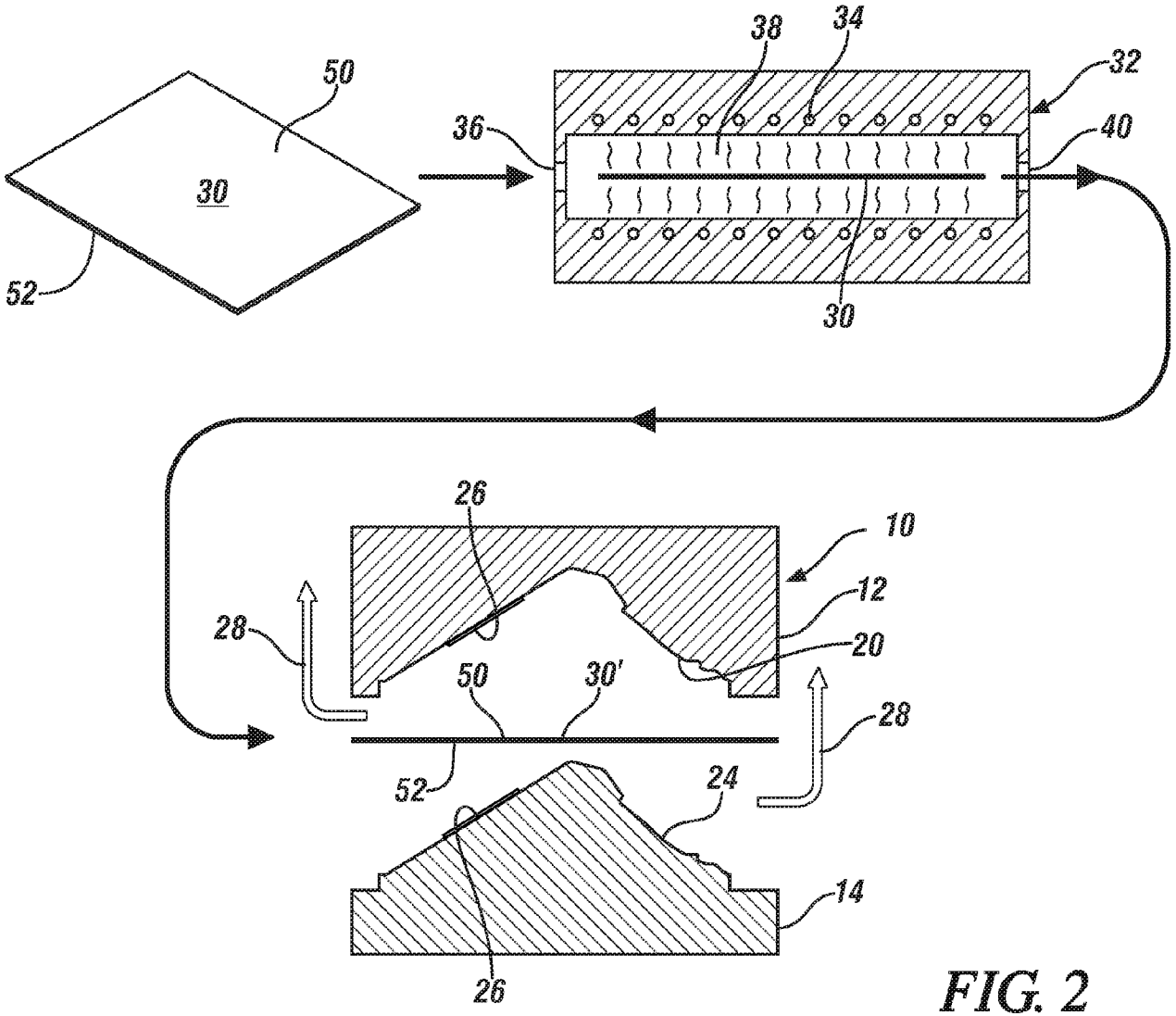
FIG. 2 is a schematic flow diagram of a sheet metal workpiece as it is brought from an inventory area, carried to a heating device where it is preheated to a forming temperature, for example in the range of about 100° C. to about 500° C., and then placed between unheated (but lubricated) forming dies for shaping into a vehicle body panel such as an outer deck lid panel.

FIG. 2 illustrates a sheet metal workpiece 30, which will often be flat, that is conveyed from a supply of such workpieces, located near the forming operation, to a heating oven 32 or other suitable heating device. The sheet metal workpiece 30 is often about one-half to about three millimeters in thickness and has opposing flat surfaces 50, 52 which will be engaged by the forming surfaces 20, 24 of forming dies 12, 14. Heating oven 32, as illustrated in FIG. 2, is provided with a heating element 34 to quickly heat workpiece 30 to a specified forming temperature for the metal alloy composition and the nature of the forming operation. As stated, forming temperatures in the range of about 100° C. to about 500° C. are intended to be used in practices of this invention. Sheet metal workpiece 30 is conveyed by suitable carrier means (not illustrated) through inlet 36 of the heating oven 32 into the heating chamber 38. Sheet metal workpiece 30 is retained in heating chamber 38 for a specified heating time and is then removed through outlet 40 from the heating oven 32.

Figure 3:
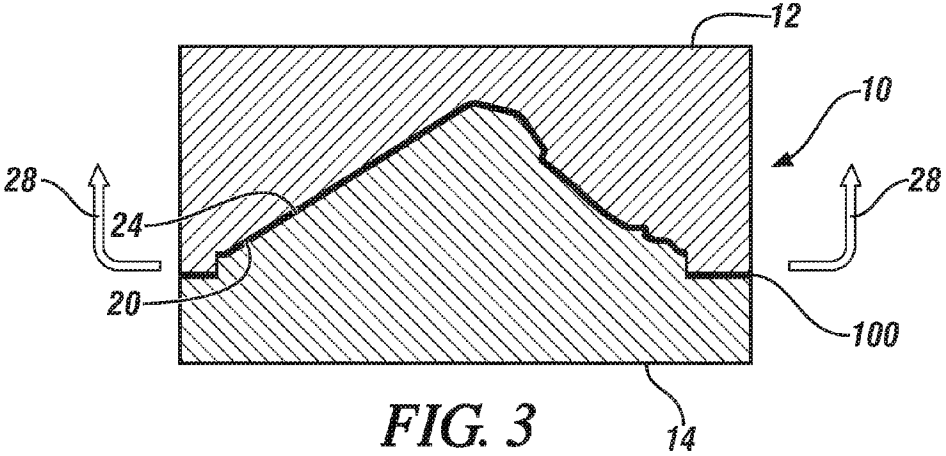
FIG. 3 illustrates, in a cross-section elevation view, the lubricated, unheated, complementary forming dies closed on the heated sheet metal workpiece to form the deck lid outer panel.

As illustrated in the flow diagram of FIG. 2, the heated workpiece 30' is then promptly placed between the liquid lubricating film 26 coated surfaces 20, 24 of forming dies 12, 14. As illustrated in FIG. 3, forming dies 12, 14 are closed by action of their press mechanism against the upper surface 50 and lower surface 52 of heated sheet metal workpiece 30'. Prior to the closing of liquid lubricant film 26 coated forming dies, surfaces 50, 52 of the heated workpiece do not have a lubricant coating. But, upon closure of forming dies 12, 14 against the facing surfaces 50, 52 of heated workpiece, the liquid lubricant film 26 on die surfaces 20, 24 is brought into contact with surfaces 50, 52 and then serves to enable the forming of heated workpiece 30' into an article 100, such as an outer deck lid panel for an automotive vehicle.

In FIG. 4, the forming dies 12 and 14 are shown as having been opened by action of their supporting press mechanism. Workpiece extraction means (not illustrated for simplicity of viewing) has separated the formed workpiece 100 from the surfaces 20, 24 of the forming dies 12, 14. Workpiece 100 is still hot and it is expected that any lubrication material will promptly vaporize from its hot surfaces and be collected in vapor recovery system 28. In some workpiece forming situations, it may be helpful to use a radiant heater (or other localized heating device) in combination with a carrier gas system to remove liquid lubricant material from the formed sheet metal workpiece. Any liquid lubricant remaining on forming die surfaces 20, 24 may be utilized in a subsequent forming operation on a following heated sheet metal workpiece.

The use of the liquid lubrication material in practices of this invention is intended to permit substantially complete removal of lubricant from surfaces (e.g. 50, 52) of the formed workpiece 100. It is preferred that the lubricant material be selected to survive the forming operation on the hot workpiece without leaving a residue (solid or liquid) on the surfaces of the workpiece that requires a lubricant removal step utilizing significant time and materials. While as stated, some lubricant may remain on the unheated surfaces 20, 24 of the forming dies 12, 14, the process is practiced with a liquid lubricant that is intended to vaporize and self-remove itself from the formed workpiece.

In many sheet metal forming plants it is expected that the forming dies will be used repeatedly with only short intervals between forming operations. Experience will teach whether additional liquid lubricant need be sprayed or otherwise applied to the forming tool surfaces after each forming operation or after a few such forming operations.

In general, it is preferred that the combination of a suitable preheating temperature for warm forming of the sheet metal workpiece and the selection of a suitable liquid lubricant applied to surfaces of unheated forming tools will enable production of complex sheet metal shapes in only one forming operation. But it is recognized that a given workpiece may require more than one forming operation in order to acquire its final shape and/or to trim or remove unneeded portions of the original sheet metal blank material. While the workpiece may require reheating before a subsequent forming step, it is preferred that no lubricant be applied to the workpiece, but that the selected liquid lubricant be applied to unheated forming tool surfaces.

Practices of the invention have been illustrated by specific examples that are not intended to limit the scope of the following claimed methods.

The invention claimed is:

1. A method of forming a sheet metal workpiece, mechanically formed using opposing, press-actuated, forming dies with opposing die forming surfaces that are closed against surfaces of the sheet metal workpiece to form it by the shape of the die forming surfaces, and the forming dies are then opened from the surfaces of the workpiece to enable removal of the formed workpiece from the forming dies and the press; the method comprising:

preheating the sheet metal workpiece to a temperature in the range of about 100° C. to about 500° C.;

applying a coating of a liquid lubricant material to only the forming surfaces of the forming dies, the forming dies being unheated above an ambient temperature, except as they may be heated by repeated forming of sheet metal workpieces, the liquid lubricant material being composed to lubricate the interface of the die forming surfaces and the surfaces of the sheet metal workpiece during forming of the workpiece and to later vaporize from the surfaces of the formed workpiece at a temperature below about 200° C.;

inserting the preheated sheet metal workpiece between the liquid lubricant material-coated forming surfaces of the forming dies;

closing the liquid lubricant material-coated forming surfaces of the forming dies against the surfaces of the preheated sheet metal workpiece to form the workpiece into the shapes of the die forming surfaces, some of the liquid lubricant material being transferred from the die forming surfaces to the heated sheet metal workpiece;

opening the forming dies for removal of the formed workpiece from the dies and press while directing a stream of a carrier gas over the surfaces of the heated workpiece to remove the transferred liquid lubricant material from the heated workpiece as vapor; and removing the formed workpiece from the press.

2. A method of forming a sheet metal workpiece as recited in claim 1 in which the sheet metal workpiece is an aluminum-based alloy or magnesium-based alloy suitable for forming at a temperature in the range of about 100° C. to about 500° C. and having a thickness in the range of about one-half millimeter to about three millimeters.

3. A method of forming a sheet metal workpiece as recited in claim 1 in which the sheet metal workpiece is an aluminum-based alloy selected from the group consisting of AA3104, AA5182, AA5754, and AA6111 alloys.

4. A method of forming a sheet metal workpiece as recited in claim 1 in which the sheet metal workpiece is a magnesium alloy selected from the group consisting of AM30, AZ31, and ZEK100 magnesium alloys.

5. A method of forming a sheet metal workpiece as recited in claim 1 in which the liquid lubricant material is a halogenated alkane hydrocarbon or a halogenated alkanol hydrocarbon.

6. A method of forming a sheet metal workpiece as recited in claim 1 in which the liquid lubricant material is a halogenated alkane hydrocarbon compound or a halogenated alkanol hydrocarbon compound, each containing up to five carbon atoms.

7. A method of forming a sheet metal workpiece as recited in claim 6 in which the halogen content of the liquid lubricant material consists of bromine.

8. A method of forming a sheet metal workpiece as recited in claim 6 in which the halogen content of the liquid lubricant material consists of iodine.

9. A method of forming a sheet metal workpiece as recited in claim 1 in which a surface of the formed workpiece is heated, after opening of the forming dies, to vaporize lubricant material from a surface of the formed workpiece.

10. A method of forming a sheet metal workpiece as recited in claim 1 in which the stream of carrier gas, which is directed over surfaces of the formed workpiece, is then further processed to recover the lubricant material.

11. A method of sequentially forming a group of substantially identical sheet metal workpieces, one by one, using only opposing, press-actuated, forming dies with opposing die forming surfaces that are closed against surfaces of each sheet metal workpiece in turn to mechanically form it into the shape of the die forming surfaces, and the forming dies are then opened from the surfaces of the workpiece to enable removal of the formed workpiece from the forming dies and the press; the method being sequentially applied to each of the workpieces in the group and comprising the following steps:

preheating each sheet metal workpiece to a temperature in the range of about 100° C. to about 500° C.;

applying a coating of a liquid lubricant material to only the forming surfaces of the forming dies, the forming dies being unheated above an ambient temperature, except as they may be heated by repeated forming of members of the sheet metal workpiece group, the liquid lubricant material being composed to lubricate the interface of the die forming surfaces and the surfaces of the sheet metal workpiece during forming of the workpiece and to later vaporize from the surfaces of the formed workpiece at a temperature below about 200° C., the liquid lubricant material being applied to the die forming surfaces at predetermined intervals prior to the forming of a member of the group of the workpieces;

inserting each preheated sheet metal workpiece, in turn, between the liquid lubricant material-coated forming surfaces of the forming dies;

closing the liquid lubricant material-coated forming surfaces of the forming dies against the surfaces of the preheated sheet metal workpiece to form the workpiece into the shapes of the die forming surfaces, some of the liquid lubricant material being transferred from the die forming surfaces to the heated sheet metal workpiece;

opening the forming dies for removal of the formed workpiece from the dies and press while directing a stream of a carrier gas over the surfaces of the heated workpiece to remove the transferred liquid lubricant material from the heated workpiece as vapor; and removing the formed workpiece from the press.

12. A method of forming a sheet metal workpiece as recited in claim 11 in which each sheet metal workpiece is an aluminum-based alloy or magnesium-based alloy suitable for forming at a temperature in the range of about 100° C. to about 500° C. and having a thickness in the range of about one-half millimeter to about three millimeters.

13. A method of forming a sheet metal workpiece as recited in claim 11 in which each sheet metal workpiece is an aluminum-based alloy selected from the group consisting of AA3104, AA5182, AA5754, and AA6111 alloys.

14. A method of forming a sheet metal workpiece as recited in claim 11 in which each sheet metal workpiece is a magnesium alloy selected from the group consisting of AM30, AZ31, and ZEK100 magnesium alloys.

15. A method of forming a sheet metal workpiece as recited in claim 11 in which the liquid lubricant material is a halogenated alkane hydrocarbon or a halogenated alkanol hydrocarbon.

16. A method of forming a sheet metal workpiece as recited in claim 11 in which the liquid lubricant material is a halogenated alkane hydrocarbon compound or a halogenated alkanol hydrocarbon compound, each containing up to five carbon atoms.

17. A method of forming a sheet metal workpiece as recited in claim 16 in which the halogen content of the liquid lubricant material consists of bromine.

18. A method of forming a sheet metal workpiece as recited in claim 16 in which the halogen content of the liquid lubricant material consists of iodine.

19. A method of forming a sheet metal workpiece as recited in claim 11 in which a surface of a formed workpiece is heated, after opening of the forming dies, to vaporize lubricant material from a surface of the formed workpiece.

20. A method of forming a sheet metal workpiece as recited in claim 11 in which the stream of carrier gas which is directed over surfaces of the formed workpieces is then further processed to recover the lubricant material.

* * * * *